United States Patent [19]

Hodge

[11] 4,002,291

[45] Jan. 11, 1977

[54] NEWSPAPER DELIVERY TUBE INSERT

[76] Inventor: Joel W. Hodge, 208 Riverview Court, Elizabethton, Tenn. 37643

[22] Filed: June 29, 1976

[21] Appl. No.: 700,917

[52] U.S. Cl. ..... 232/17; 232/1 C
[51] Int. Cl.[2] ..... B65D 91/00
[58] Field of Search ..... 232/1 C, 17

[56] References Cited

UNITED STATES PATENTS

| | | | |
|---|---|---|---|
| 2,120,857 | 6/1938 | Crawford et al. | 232/1 C |
| 2,156,858 | 5/1939 | Landis | 232/17 |
| 2,414,613 | 1/1947 | Ruetsch | 232/17 |
| 2,807,409 | 9/1957 | Gieseler | 232/1 C |
| 2,845,217 | 7/1958 | Jacques | 232/17 X |
| 3,042,293 | 7/1962 | Miller | 232/1 C |
| 3,275,228 | 9/1966 | Golla | 232/1 C |

*Primary Examiner*—James T. McCall
*Assistant Examiner*—Peter A. Aschenbrenner
*Attorney, Agent, or Firm*—Donald R. Cassady; R. Laddie Taylor

[57] ABSTRACT

An insert bracket is provided for insertion into a newspaper tube of one-piece elongated, generally cross-section, hollow body construction, open at one end and closed at the other, which insert comprises three descending legs connected at the top, two of which are opposing legs which follow generally the interior contours of the tube terminating at about the lower interior sides of the tube, and the third lying flat against the rear of the tube; from the connection of the legs is attached a spring steel newspaper support member which first descends to about the middle of the tube then forms a wide ascending arch nearly to the top of the tube terminating near the front of the tube in a reverse bend to act as a finger hold to lower the clip when placing a newspaper between the insert bracket and the inside top of the tube.

4 Claims, 3 Drawing Figures

NEWSPAPER DELIVERY TUBE INSERT

BACKGROUND OF THE INVENTION

Delivery of newspapers in rural and suburban areas by motor carrier is customary in many parts of the country. In these areas a receptacle is provided for receipt of the paper. This receptacle generally consists of a metal or plastic tube of one piece construction open on one end and slightly tapered away from the open end.

Such receptacles often become wet inside and at the bottom of the tube due to rain beating on the open end thereof, or merely by collection of moisture along the bottom externally followed by ingress interiorly through longitudinal bottom openings customarily provided, or through apertures through which fasteners are projected.

Ridges are sometimes molded in the bottom of the tube to raise the paper therefrom and to provide additional longitudinal stability and strength. Such a modification in structure is provided for in U.S. Pat. No. 3,134,538, and U.S. Pat. No. 3,181,782.

These ridges have not been completely successful in keeping a paper dry and others have invented and devised methods and devices to compartmentalize the tube to keep the paper at or near the top of the tube. Miller, in U.S. Pat. No. 3,042,293, has provided a spring clip which holds the paper between the clip and the inside top of the tube. This particular device is quite effective in keeping the paper dry, but suffers the disadvantage that the delivery person must always install the paper in that manner, thus slowing delivery and limiting the size of routs. A preferrable device would give the delivery person the option of using the tube in the normal manner or the slower but paper protecting manner.

SUMMARY OF THE INVENTION

It is an object of this invention to provide a device which will protect the newspaper from rain and water lying on the bottom of the newspaper delivery tube.

It is a further object of this invention to provide a newspaper protecting device which will allow the tube to be used in a normal manner in good weather and a protective manner in inclement weather.

Still further, it is an object of this invention to provide a device that can be easily installed in newspaper delivery tubes already installed and operative as well as in new tubes during manufacture, sale, or installation.

This invention provides a spring clip similar to the Miller device which will allow the newspaper delivery tube to be used in a normal manner as well as in a paper protective manner. The device comprises three leg members and a spring clip member. All four members are connected at a common point, which, when the device is inserted in the tube, will reside at the top, rear of the tube. Two legs descend from the point of common connection in an opposed manner following generally the contours of the inside of the tube, terminating at the inside base of the tube. The third leg member descends from the common connection following generally and fitting snugly against the rear of the tube. This leg terminates at a point below the mid-point of the rear of the tube. In a preferred embodiment, this leg terminates at a point about three-fourths down the rear of the tube. The spring clip member descends from the point of common connection to a point about one-half the inside height of the tube then rises in a wide arc ascending toward the front of the tube to a point near the top at or near the front of the tube. The spring clip terminates in a reverse bend which acts as a finger hold which can be used by the delivery person to lower the clip portion of the device from its position of rest near the top of the tube and place a paper between the clip portion and the top of the tube.

DETAILED DESCRIPTION OF THE DRAWINGS

In order to more clearly disclose the construction, operation, and use of the invention, reference should be made to the accompanying drawings forming a part of the disclosure. Throughout the drawings, like reference characters designate the same part.

Figure 1:
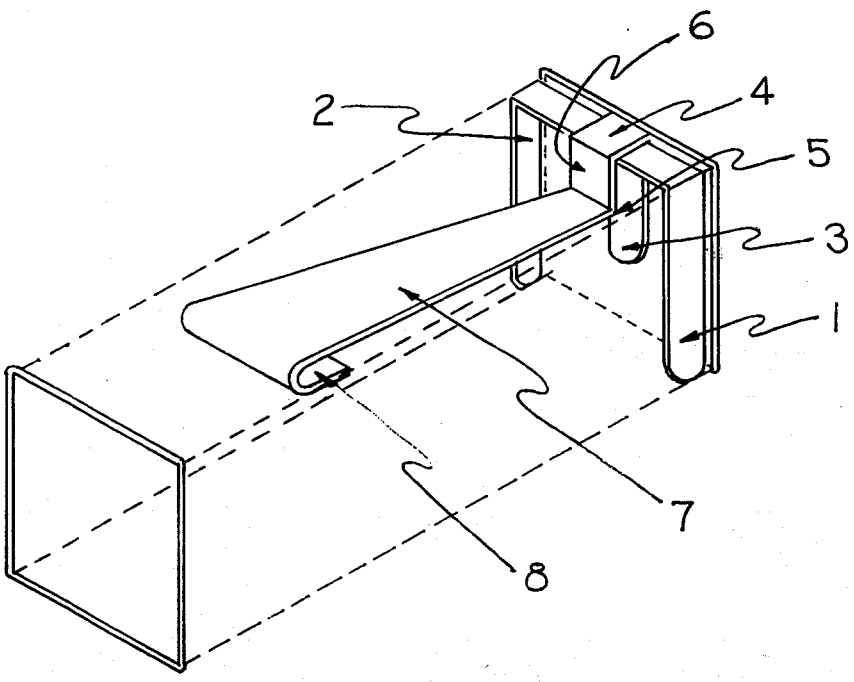
FIG. 1 shows the device of this invention when installed in a newspaper delivery tube.

In the drawings, legs 1, 2, and 3 are shown connected at a common point 4. Legs 1 and 2 are opposing legs which descend to the bottom of the tube following generally the contours of the inside of the tube. It is obvious that if the tube were of round or oblong construction, the shape of the descending legs would be of a shape to follow the interior contours of that shape of tube. Leg 3 is also a descending leg following generally the contours of the rear of the tube and fitting snugly thereagainst when the device is properly installed in the tube. The leg 3 should extend at least one-half of the vertical height of the tube, and in a preferred embodiment will extend to a point about three-fourths the height of the tube. The length of this leg prevents the device from pivoting and loosening when the spring clip is depressed during usage.

The spring clip 5 is connected at the common point 4 from which point it forms a descending leg 6 terminating at about the mid-point of the tube, then forming a wide ascending arch 7 toward the front of the tube. The clip approaches the top of the tube at a point in the front one-half of the tube then terminates in a reverse curve 8. The reverse curve 8 should be sufficiently separated from the clip member that the space formed therebetween can admit the finger of the paper deliverer. In use, in good weather the newspaper can be tossed into the tube in the usual manner and the clip member will be inoperative and not block the entrance of the tube. In rainy weather or when the bottom of the tube is wet, the deliverer can depress the spring clip with a finger and force the paper between the clip and the inside top of the tube.

The device of this invention can be fabricated out of four separate strips of material connected at the common point 4, or, as shown in the drawings, the device can be fabricated out of two strips of material crossing at about right angles at the common point 4. The device of this invention can be manufactured out of metal or plastic.

It is within the scope of this invention that the rear leg 3 can be attached to the rear of the tube by a rivit, screw, bolt, or the like fastening device.

Figure 2:
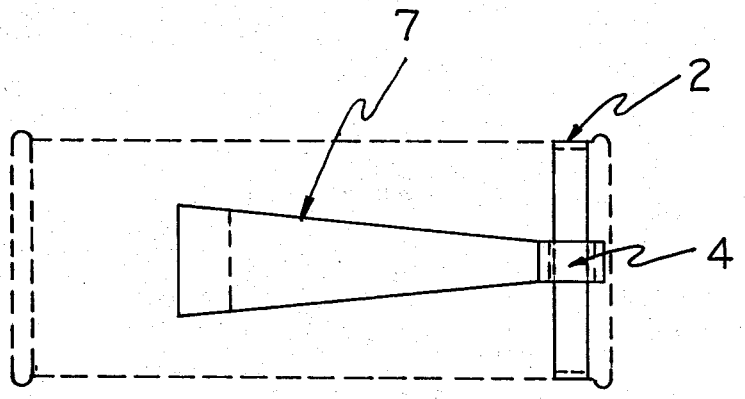
FIG. 2 shows the device of this invention from a vertical view when installed in a newspaper delivery tube.
Figure 3:
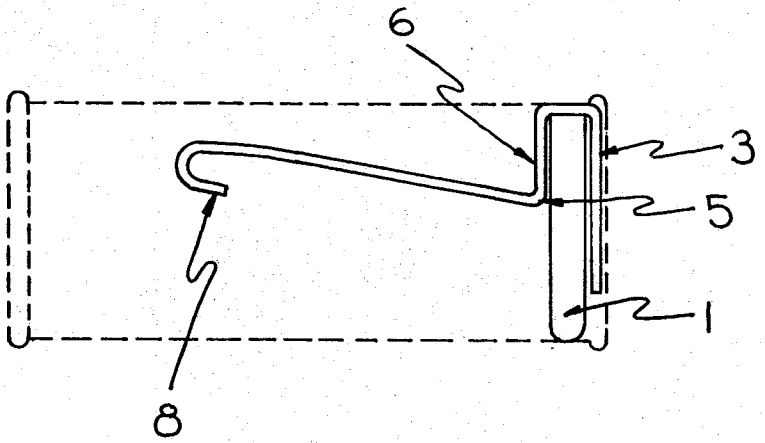
FIG. 3 shows the device of this invention when installed in a horizontal view.

In a preferred embodiment, the spring clip member 5 shall increase in width toward the front of the tube while in the ascending arch 7 attitude. This preferred embodiment is shown clearly in FIG. 2.

I claim:

1. A readily insertable newspaper support bracket device for insertion into a newspaper delivery tube of one piece, elongated, hollow body construction open at one end and closed at the other; which support device comprises three descending legs connected at a common point, two of which are opposing legs which substantially follow the contours of the interior of the tube terminating at the lower inside edges of the rear end of the tube when the device has been inserted in the tube, and the third leg flat against the closed end of the tube when inserted; and a spring clip attached at the hereinbefore defined common point, which spring clip descends to about the mid-point of the tube then forms a wide ascending arch nearly to the top of the tube terminating in the front one-half of the tube in a reverse bend to act as a finger hold.

2. The device of claim 1 wherein the third leg terminates at a point below the mid-point of the tube.

3. The device of claim 1 wherein the third leg terminates at a point about three-fourths down the height of the tube.

4. The device of claim 1 wherein the spring clip increases in width toward the front of the tube while in the ascending arch attitude.

* * * * *